US009583885B2

(12) United States Patent
Ruesca Fernandez

(10) Patent No.: US 9,583,885 B2
(45) Date of Patent: Feb. 28, 2017

(54) CONNECTOR ASSEMBLY WITH GROUNDING SPRING

(71) Applicant: CommScope Connectivity Spain, S.L., Alcobendas, Madrid (ES)

(72) Inventor: Ángel Ruesca Fernandez, Granollers (ES)

(73) Assignee: COMMSCOPE CONNECTIVITY SPAIN, S.L, Madrid (ES)

( * ) Notice: Subject to any disclaimer, the term of this patent is extended or adjusted under 35 U.S.C. 154(b) by 0 days.

(21) Appl. No.: 15/079,384

(22) Filed: Mar. 24, 2016

(65) Prior Publication Data

US 2016/0285205 A1 Sep. 29, 2016

(30) Foreign Application Priority Data

Mar. 27, 2015 (ES) ..... 201530417

(51) Int. Cl.

| | |
|---|---|
| ***H01R 4/66*** | (2006.01) |
| ***H01R 13/652*** | (2006.01) |
| ***H01R 24/64*** | (2011.01) |
| ***H01R 43/22*** | (2006.01) |
| *H01R 107/00* | (2006.01) |

(52) U.S. Cl.

CPC ..... *H01R 13/652* (2013.01); *H01R 24/64* (2013.01); *H01R 43/22* (2013.01); *H01R 2107/00* (2013.01)

(58) Field of Classification Search

CPC ..... H01R 12/596
USPC ..... 439/98, 578, 607.41, 607.42
See application file for complete search history.

(56) References Cited

U.S. PATENT DOCUMENTS

| | | | | |
|---|---|---|---|---|
| 3,739,076 A * | 6/1973 | Schwartz | H01R 13/648 | 174/665 |
| 3,830,957 A * | 8/1974 | Oberdiear | H01R 13/648 | 174/653 |
| 4,537,458 A * | 8/1985 | Worth | H01R 13/6584 | 439/497 |
| 4,747,785 A * | 5/1988 | Roberts | H01R 13/65802 | 439/465 |
| 4,790,765 A * | 12/1988 | Ehrenfels | H01R 9/037 | 439/799 |
| 4,810,210 A * | 3/1989 | Komatsu | H01R 9/032 | 439/352 |
| 4,824,400 A * | 4/1989 | Spinner | H01P 1/045 | 333/254 |
| 4,830,628 A * | 5/1989 | Dyson | H01R 13/648 | 439/579 |
| 4,842,553 A * | 6/1989 | Ingram | H01R 9/0521 | 29/754 |

(Continued)

FOREIGN PATENT DOCUMENTS

| | | |
|---|---|---|
| EP | 1484824 A2 | 12/2004 |
| ES | 1138538 | 4/2015 |

*Primary Examiner* — Neil Abrams
(74) *Attorney, Agent, or Firm* — Merchant & Gould P.C.

(57) ABSTRACT

A connector assembly (10) is disclosed in which a connector part (12) and a cable manager part (20) are provided. The cable manager part (20) can be provided with a housing part (40) that functions to ensure a grounded connection between the connector assembly (10) and a sheath (5) of a cable (4) via one or more springs (60, 66) secured within the housing part (40). In one embodiment, two parallel helical springs (60, 66) are disposed within the housing part (40).

20 Claims, 9 Drawing Sheets

(56) References Cited

U.S. PATENT DOCUMENTS 4,857,015 A * 8/1989 Michaels ..... H01R 13/648 439/462
5,278,352 A * 1/1994 Schade ..... H01R 4/643 174/653
5,310,359 A * 5/1994 Chadbourne ..... H01R 13/59 439/462
5,691,506 A * 11/1997 Miyazaki ..... H01R 4/646 174/652
5,697,806 A * 12/1997 Whiteman, Jr. ..... H01R 31/00 439/353
6,254,403 B1 * 7/2001 Bernardini ..... H01R 13/65802 439/95
6,354,851 B1 * 3/2002 Bachle ..... H02G 15/04 174/650
6,386,915 B1 * 5/2002 Nelson ..... H01R 9/0527 439/579
6,520,781 B2 * 2/2003 Koide ..... H01R 13/748 439/97
6,537,104 B1 * 3/2003 Hagmann ..... H02G 3/0666 439/460
7,156,696 B1 * 1/2007 Montena ..... H01R 9/05 174/59
7,416,448 B2 * 8/2008 Gaidosch ..... H01R 9/031 439/607.41
7,727,013 B1 * 6/2010 Paynter ..... H01R 9/0527 439/578
7,819,698 B2 * 10/2010 Islam ..... H01R 9/05 439/578
8,454,383 B2 * 6/2013 Paynter ..... H01R 9/0521 439/578
8,747,126 B2 * 6/2014 Corbett ..... H01R 4/66 439/98
9,022,792 B2 * 5/2015 Sticker ..... H01R 9/0527 439/98
2011/0030343 A1 2/2011 Kiser et al.
2011/0304343 A1 * 12/2011 Font Aranega ..... H01R 43/015 324/538
2016/0285205 A1 * 9/2016 Ruesca Fernandez ..... H01R 13/652

* cited by examiner

CONNECTOR ASSEMBLY WITH GROUNDING SPRING

RELATED APPLICATIONS

This application claims benefit of Serial No. P201530417, filed 27 Mar. 2015 in Spain and which application is incorporated herein by reference. To the extent appropriate, a clai of priority is made to the above disclosed application.

BACKGROUND

Electrical connectors are useful for providing a connection point for telecommunications systems. For example, RJ-type connectors can be provided as wall sockets wherein electronic data cables are terminated and mating electrical plugs can be inserted into the sockets. Frequently, this termination process occurs in the field and at the actual location where the cables to be attached to the connectors are being installed. In such instances, it is often necessary to provide a grounding connection between the cable and its attached connector.

SUMMARY

A connector assembly is disclosed. In one aspect, the connector assembly includes a connector part having a jack cavity and a cable manager part. The cable manager part can be configured to be installed within the connector part to form the connector assembly.

The cable manager part may include a housing part having a first side and a second side, wherein the housing part has a central aperture disposed between the first and second sides. A first and second grounding spring extending between the housing part first and second sides may also be provided, wherein the springs at least partially extend across the central aperture. In one aspect, when a cable is inserted through the aperture, the grounding spring(s) contacts a sheath of the cable to provide a grounding connection between the cable sheath and the housing and connector parts.

A method for terminating a connector to a plurality of wires of a cable is also disclosed. One step in the method can providing a cable manager including a housing part having a central aperture across which one or more grounding springs extend. Another step can be inserting a cable having a plurality of wires through the main body central aperture such that a sheath of the cable comes into conductive contact with the one or more grounding springs. Other steps in the method can be partially inserting a connector part onto the cable manager part, and placing the connector part and the cable manager part within a wire connector tool. Another step can be actuating the wire connector tool to fully insert the connector part onto the cable manager part to form a connector such that the connector part, housing part, and sheath are all in conductive contact with each other. After the connector is formed, the connector can be removed from the wire connector tool.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
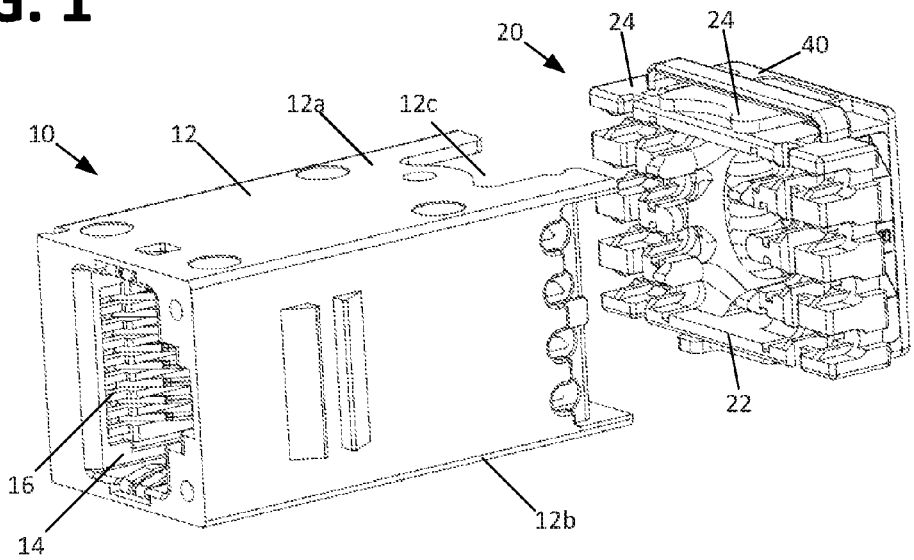
FIG. 1 is a front perspective view of a telecommunications connector having a separated connector part and a cable manager part having features that are examples of aspects in accordance with the principles of the present disclosure.
Figure 2:
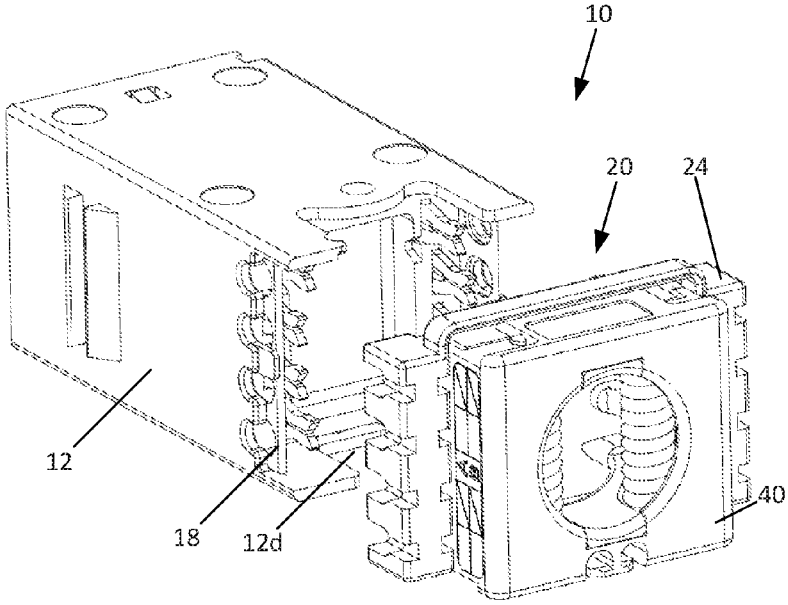
FIG. 2 is a rear perspective view of the separated connector part and cable manager part shown in FIG. 1.
Figure 3:
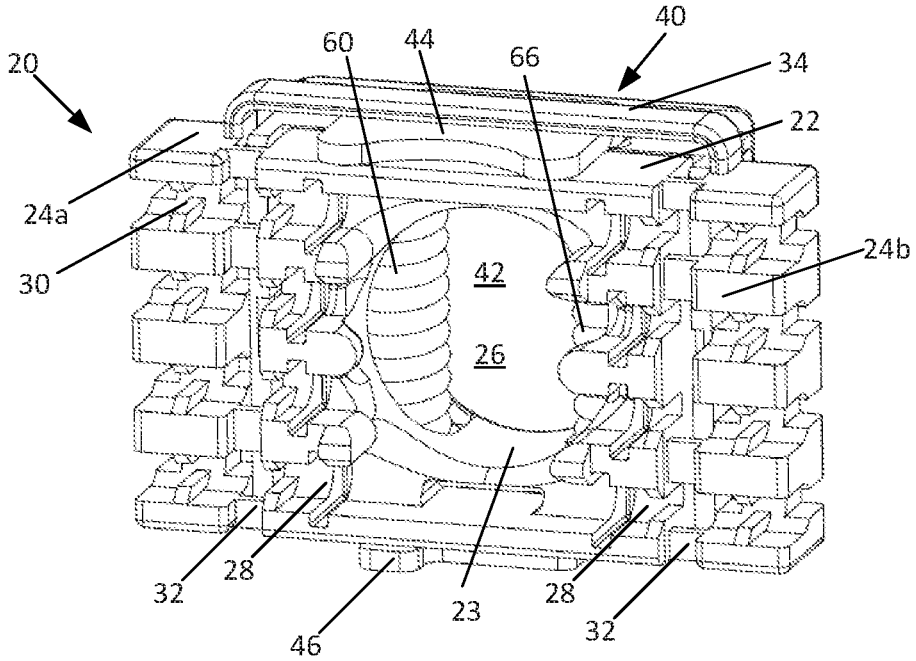
FIG. 3 is a front perspective view of the cable manager part shown in FIG. 1.
Figure 4:
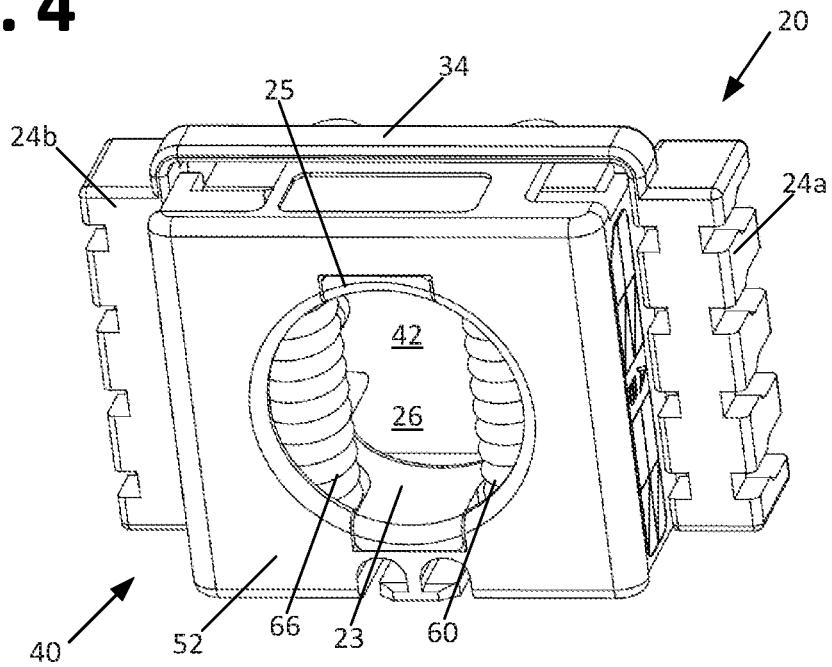
FIG. 4 is a rear perspective view of the cable manager part shown in FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A telecommunications connector 10 for grounded connection with a cable 4 having a sheath 5 and a plurality of wires 6 is shown. In some examples, the sheath 5 can be formed from a metal braid, mesh, or foil. In one example, the cable 4 includes a plurality of insulated copper wires 6 while the connectors 10 are modular or RJ-type connectors. As shown, the telecommunications connector has a connector part 12 which includes a jack cavity 14 for receiving a corresponding plug (not shown). In one aspect the connector part 12 includes a plurality of electrical contact members 16 for which electrical connection to the wires 6 will be made through the below described termination and connection process. The connector part 12 is further provided with a pair of cutting edges 18 which are designed to cut the wires 6 of the cable 4 during the termination process. As shown, the connector part 12 has conductive sidewalls 12*a*, 12*b* which are formed from a conductive material, such as a metal material. In one aspect, the sidewalls 12*a*, 12*b* each define a respective recess portion 12*c*, 12*d*. The recess portions 12*c*, 12*d* receive and connect to the housing part first and second sides 44, 46 respectively, such that conductive contact is established between the housing part 40 and the sidewalls 12*a*, 12*b* of the connector 10. Accordingly, the connector 10 is grounded to the cable sheath 5 via the springs 60, 66, the housing part 40, and the sidewalls 12*a*, 12*b*.

The connector 10 is also provided with a cable manager part 20 having a main body 22 to which a housing part 40 is adjoined. The connector part 12 and the cable manager part 20 used in the various embodiments may be configured in a complementary manner, so that the connector part 12 is able to engage with the cable manager part 20 only in one orientation. In general, the main body 22 is for facilitating the connection between the conductors in the wires 6 and the contact members 16 while the housing part 40 is for providing a grounding pathway from the cable sheath 5 to the connector 10.

Grounding Features

Figure 7:
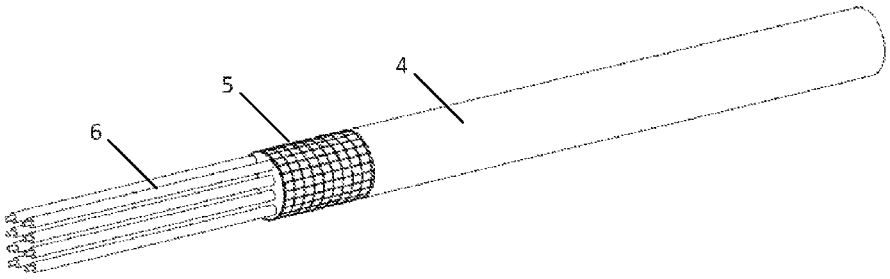
FIG. 7 is a perspective view of a cable having a plurality of wires and a conductive sheath for use with the connector shown in FIG. 1.
Figure 8:
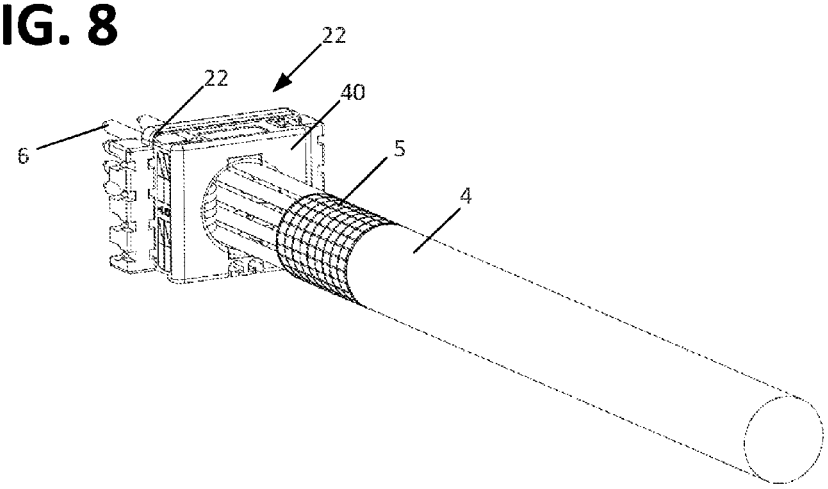
FIG. 8 is a rear perspective view of the cable shown in FIG. 7 being partially inserted into the cable manager part shown in FIG. 1.
Figure 9:
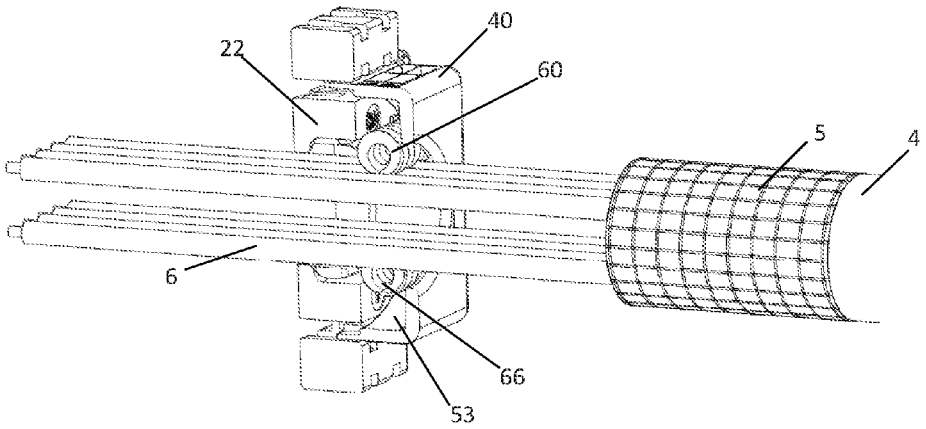
FIG. 9 is a rear cross-sectional perspective view of the cable shown in FIG. 7 being partially inserted into the cable manager part shown in FIG. 1.
Figure 10:
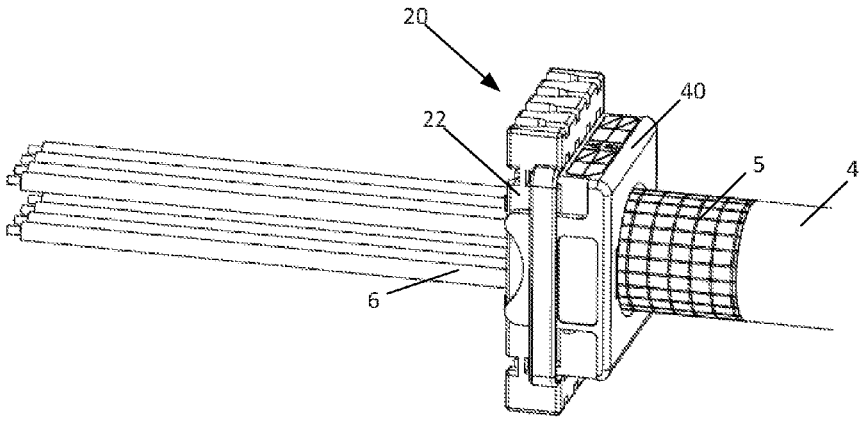
FIG. 10 is a rear perspective view of the cable shown in FIG. 7 having been fully inserted into the cable manager part shown in FIG. 1.

As shown, the main body 22 is provided with a central aperture 26 while the housing part 40 is likewise provided with a central aperture 42 coaxially aligned with main body central aperture 26. Once installed, the cable 4 and associated wires 6 extend through both of the apertures 26, 42. Referring to FIG. 7, the cable 4 has been stripped to expose the sheath 5 and eight insulated copper wires 6. FIGS. 8 and 9 show the cable partially inserted into the housing 40 and main body 22. FIG. 10 shows the cable 4 being fully inserted such that the sheath 5 is extends through aperture 42 of the housing 40 such that grounding contact between the sheath 5 and the housing part 40 can be accomplished, as explained further below.

In one aspect, the housing part 40 has a first side 44 and a second side 46, wherein the central aperture 42 disposed between the first and second sides 44, 46. In one aspect, the first and second sides 44, 46 are configured to engage with the main body 22 to form a secure connection between the housing part 40 and the main body 22 and/or to engage with the connector part 12 to form a secure connection between the housing part 40 and the connector part 12. The housing part 40 can also be provided with a third side 48 and a fourth side 50 on opposite sides of the aperture 42 and adjacent to the first and second sides 44, 46. The housing part 40 can also be provided with a fifth side 52. As shown, the fifth side 52 extends between and acts as a base for each of the sides 44, 46, 48, 50, and also defines the central aperture 42. Together, the sides 44 to 52 can define a recessed area or cavity 53.

In another aspect, the housing part can be provided with a first grounding spring 60 and a second grounding spring 66. As shown, for example at FIG. 6, the first grounding spring 60 has a first end 62 and a second end 64 while the second grounding spring 66 has a first end 68 and a second end 70. As most easily seen at FIG. 5, the first grounding spring 60 is shown within the cavity 53 of the housing part 40 and generally extending between the housing part 40 first and second sides 44, 46. Similarly, the second grounding spring 66 is shown within the cavity 53 of the housing part 40 and generally extending between the housing part 40 first and second sides 44, 46.

Figure 5:
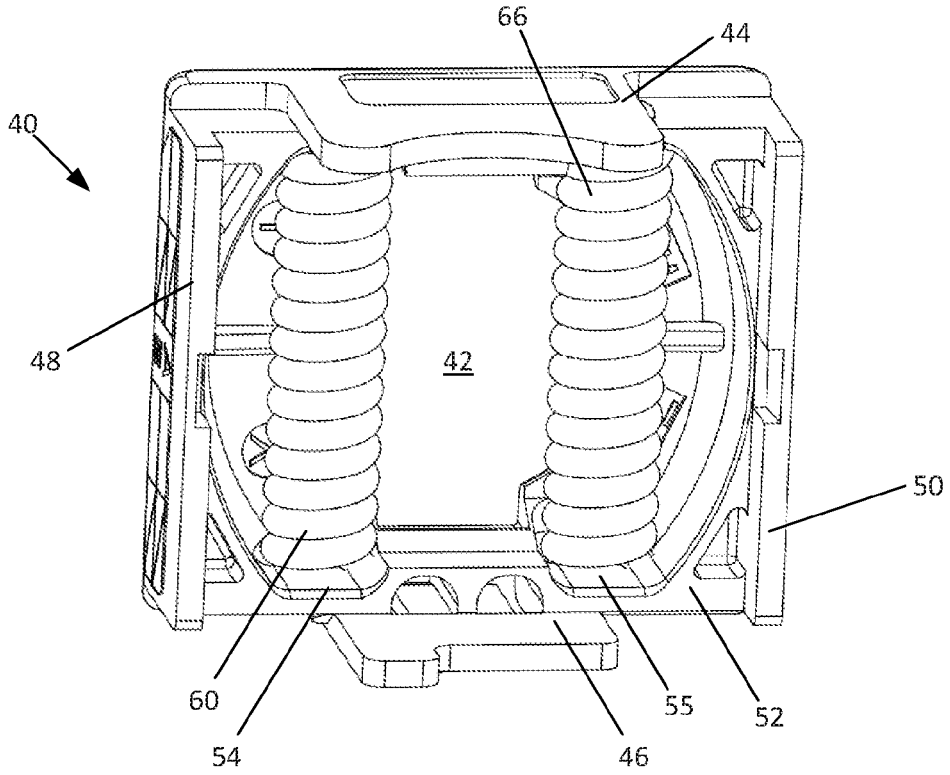
FIG. 5 is a front perspective view of a housing part and grounding springs of the cable manager part shown in FIG. 1.
Figure 6:
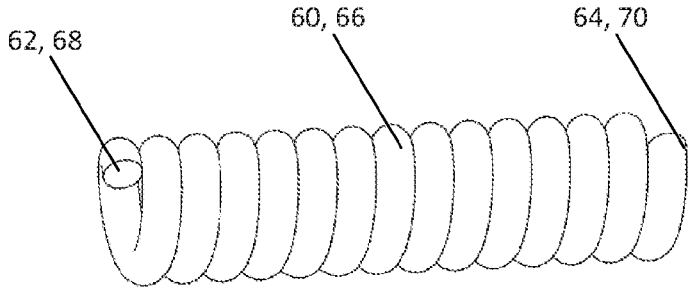
FIG. 6 is a front perspective view of a grounding spring of the cable manager part shown in FIG. 5.

In one example, and as most easily seen at FIG. 5, interior wall structures 54, 55 can be provided within the housing part cavity 53 to provide grounding contact between the first and second grounding springs 60, 66 and the main body 22 and/or connector part 12. As shown, the interior walls 54, 55 are configured such that the first and second ends 62, 64 of the first grounding spring 60 engage with the wall structure 54 and such that the first and second ends 68, 70 of the second grounding spring 66 engage with the wall structure 55.

Figure 11:
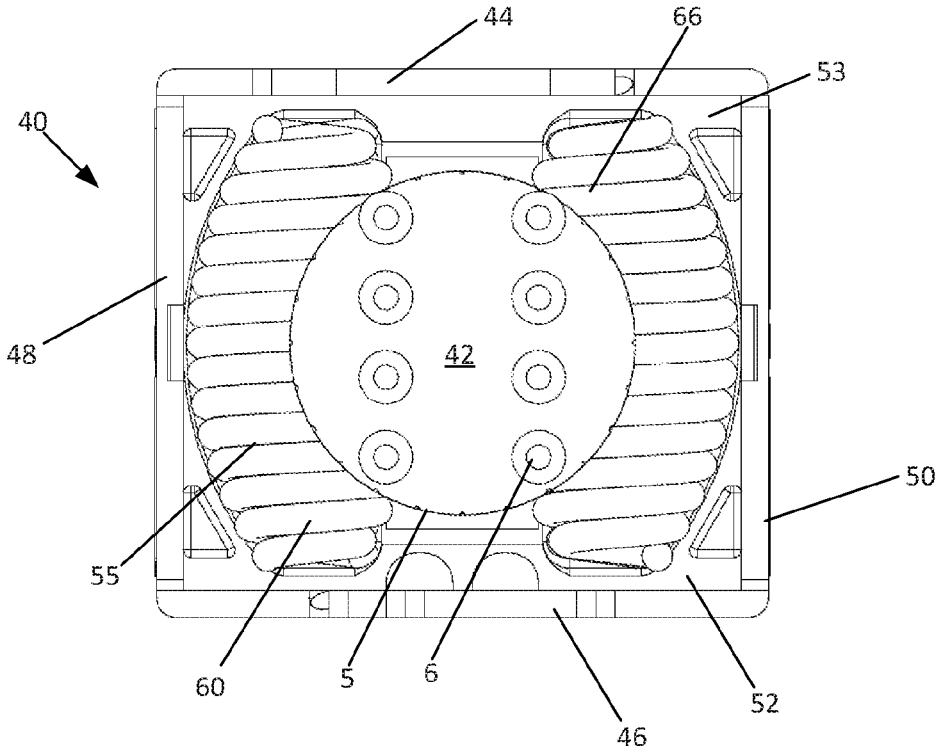
FIG. 11 is a front view of the housing and grounding springs shown in FIG. 5.

In one aspect, the grounding springs 60, 66 are generally oriented within the housing part cavity 53 such that at least some portion of the springs 60, 66 extends across a portion of the aperture 42. In this way, the grounding springs 60, 66 can be said to obscure or block a portion of the central aperture 42 to result in a smaller remaining opening area. Accordingly, when a cable 4 having a nominal a diameter that is larger than the remaining open area is inserted through aperture 42, an interference fit will be produced which will cause the springs 60, 66 to laterally deflect outwardly to allow the cable 4 to fully pass through the aperture 42. As the sheath 5 of the cable 4 is exposed at this location on the cable 4, the springs 60, 66, which are elastically deformed about the sheath 5, will exert a compressive force on the sheath 5 thereby ensuring that a conductive contact exists between the springs 60, 66 and the sheath 5. With reference to FIG. 11, the elastic deformation of the springs 60, 66 is illustrated and shows that the springs 60, 66 engage with the sheath 5 of the cable to create a conductive connection between the springs 60, 66 and the sheath 5.

Further grounding contact is achieved through the connections between the housing part 40 and the main body 22 and/or between the housing part 40 and the connector portion 12. In one aspect, the connection between the housing part 40 and the main body 22 functions to enclose the cavity 53 such that the springs 60, 66 are fully retained and secured within the housing part 40. In the example embodiment shown, the housing part 40 is retained onto the main body 22 via latches 23, 25 provided on the main body that extend into the central aperture 42 and engage the fifth side 52. In one aspect, the latches 23, 25 define a portion of the central passageways 26, 42.

As shown, the grounding springs 60, 66 are helical springs formed from a conductive material, such as a metal (e.g. steel, copper, etc.). However, the grounding springs 60, 66 can take the form of other types of springs so long as the springs elastically deform about the cable 4 when the cable is inserted through the central aperture 42 of the housing part 40, as described above. In the example shown, the housing part 40 is formed from a conductive material, such as a metal material, such that conductive contact exists between the housing part 40 and the springs 60, 66.

Figure 16:
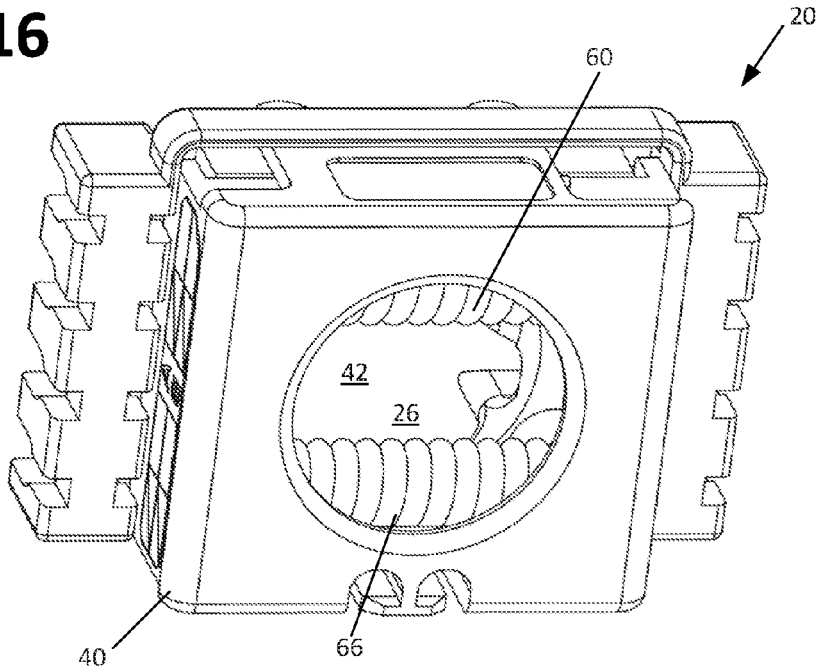
FIG. 16 is a perspective view of a second embodiment of a housing part having features that are examples of aspects in accordance with the principles of the present disclosure, wherein the springs in housing part are oriented in a generally horizontal configuration.
Figure 17:
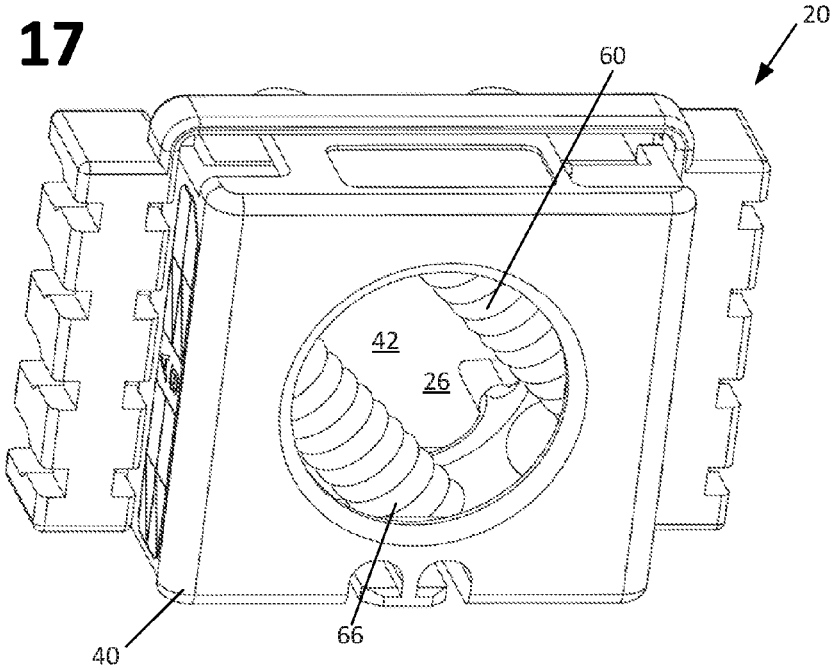
FIG. 17 is a perspective view of a second embodiment of a housing part having features that are examples of aspects in accordance with the principles of the present disclosure, wherein the springs in housing part are oriented in an angled.

As shown in FIGS. 1-5, the grounding springs 60, 66 are presented as being generally linearly aligned and in a vertical and parallel arrangement. However, the springs 60, 66 may be provided in other orientations, such as the horizontal arrangement shown in FIG. 16 and the angled arrangement shown in FIG. 17. It is also noted that only a single spring 60 or 62 can be utilized instead of two springs, if desired.

Wire Management Features

In one aspect, the main body 22 is shown as having an initially attached separable lacing fixture 24. The structure and function of the separable lacing fixture 24 is fully explained in Spain patent application Serial No. P201530372 entitled, "Connector with Separable Lacing Fixture" which was filed on Mar. 20, 2015, the entirety of which is incorporated by reference herein.

Figure 12:
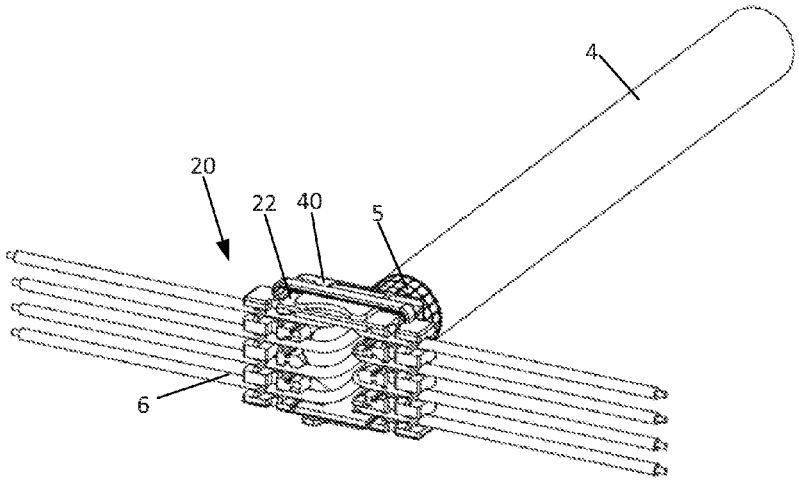
FIG. 12 is a perspective view of the cable and cable manager part shown in FIG. 10, wherein each of the insulated wires of the cable have been mounted to a separable lacing fixture of the cable manager part.

The main body 22 also includes a plurality of channels 28, each of which is configured to receive and retain an individual wire 6 of the cable 4. As shown, eight channels 28 are provided so as to accommodate a cable having eight wires 6. Aligned with the channels 28 of the main body are an equal number of lacing fixture channels 30 are also configured to receive and retain an individual wire 6. Accordingly, each wire 6 is received and retained by both a channel 28 and a channel 30. As shown at FIG. 12, the wires 6 have been oriented from the position shown in FIG. 10 to a position in which each wire 6 is held within corresponding channels 28 and 30.

Figure 13:
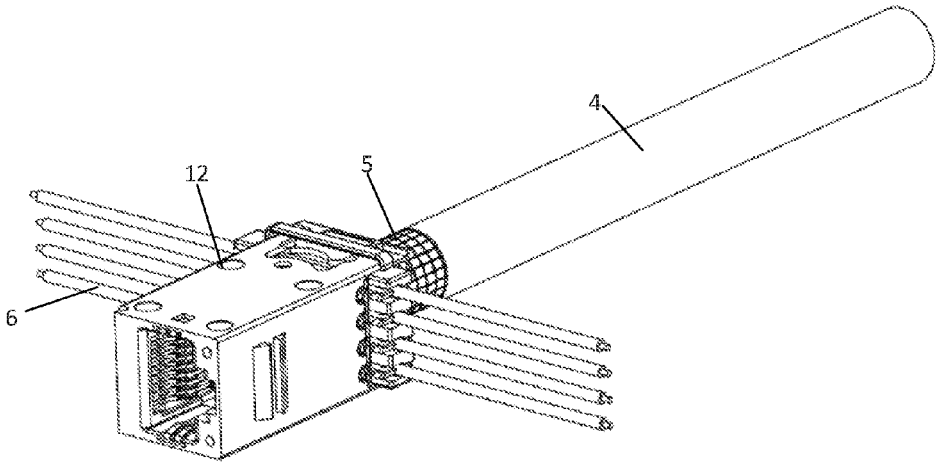
FIG. 13 is a perspective view of the cable manager part and cable shown in FIG. 12 with the connector part having been partially installed onto the cable manager part.

As shown, the separable lacing fixture 24 is attached to the main body 22 via a plurality of breakaway portions 32 which extend one each side of the channels 30. The breakaway portions 32 are aligned such that the cutting edges 18 of the connector part 12 are aligned when the connector part 12 is attached to the cable manager part 20. Thus, when the connector part 12 is fully installed onto the cable manager part 20, the cutting edges 18 not only cut the wires 6, but also cut or break the breakaway portions 32, thereby separating the separable lacing fixture 24 from the main body 22. FIG. 13 shows the connector part 12 inserted onto the cable manager part 20, but not up to the point where the cutting edges 18 will sever the breakaway portions 32.

In one aspect, the separable lacing fixture 24 includes a first portion 24*a* and a mirror image second portion 24*b*, wherein each of the portions 24*a*, 24*b* has an equal number of channels 30 and breakaway portions 32. As shown, each portion 24*a*, 24*b* has four channels 30 and five aligned breakaway portions 32. The separable lacing fixture 24 may also be provided with a bridge portion 34 extending between the first and second portions 24*a*, 24*b*. The separable lacing fixture 24 may be provided with one bridge portion, two bridge portions, or no bridge portions. The bridge portion 34 allows the separable lacing fixture 24 to remain intact as a single component after the separable lacing fixture 24 has been separated from the main body 22.

Connector Assembly and Wire Termination

Figure 14:
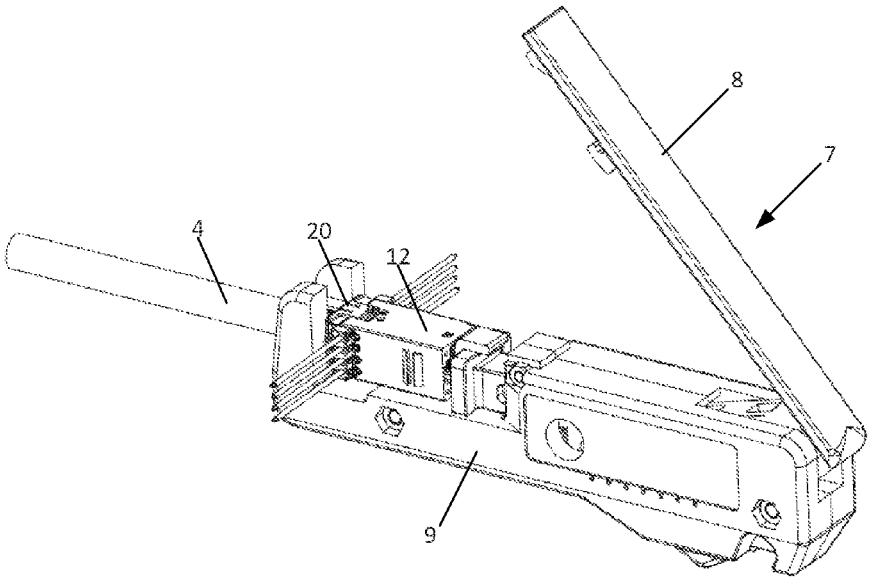
FIG. 14 is a perspective view of the connector and cable shown in FIG. 13 having been installed into a wire connector tool.
Figure 15:
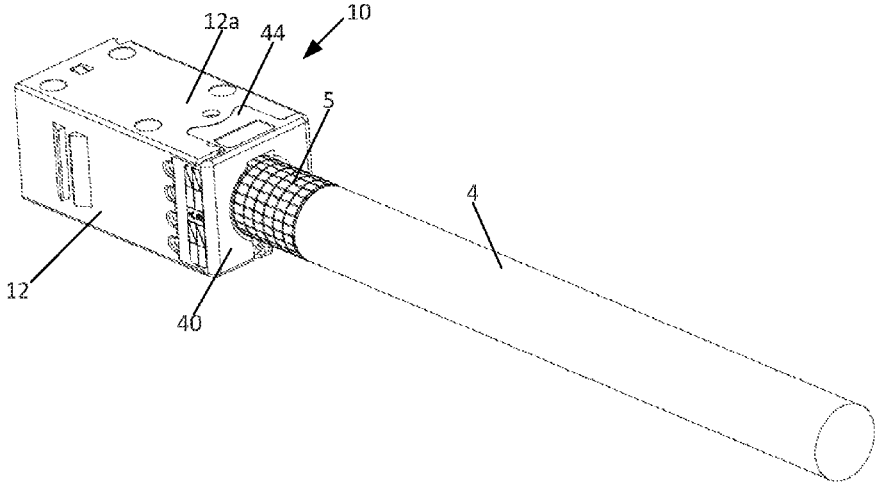
FIG. 15 is a perspective view of the fully assembled, terminated connector and cable shown in FIG. 14 having been removed from the tool.

A connector tool 7 is frequently used for the purpose of terminating the wires 6 and to form the fully assembled connector 2. Such a tool 7 is shown at FIG. 14. Connector tools 7 are known and described in US Patent Application Publication 2011/0304343 A1 and in European Patent EP 1 484 824 B1, the entireties of which are herein incorporated by reference. As shown, the connector tool 7 may be provided with a handle portion 8 and a base portion 9. The force used by squeezing the handle 8 to the tool body 9 is generally normal to the cable axis which is to be terminated.

Once the connector part 12 has been initially inserted onto the cable manager part 20, as shown at FIG. 14, the cable manager part 20 and the connector part 12 are then placed in the tool 7, with the tool 7 being in a retracted position. The handle 8 of the tool 7 is then squeezed so that a pusher element 9*a* moves laterally into an extended position and thereby forces the connector part 12 fully into engagement with the cable manager part 20 and the housing part 40 to create a fully formed connector 10 that is securely grounded to the cable 4. The body 9 of the connector tool 7 provides the necessary opposing force for the terminal insertion within the connector part 12. As this occurs, each wire 6 is additionally pushed further towards an appropriate slot in one of a plurality insulation displacement contacts in the connector part 12.

As the tool 7 is advanced towards the fully extended position, the cutting edges 18 of the connector part 12 also advance towards the breakaway portions 32 and the wires 6 and eventually cut entirely through the breakaway portions 32 and the wires 6. As a result, severed wires are formed which are retained onto the separated lacing fixture 24 which is held together by the bridge portion 34.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

PARTS LIST

2 terminated connector and cable
4 cable
5 sheath
6 wires or filaments
6*a* excess wires
7 connector tool
8 handle portion
9 body portion
9*a* pusher
10 connector assembly
12 connector part
12*a* first side
12*b* second side
14 jack cavity
16 electrical conductors
18 cutting edges
20 cable manager part
22 main body
23 latch
24 separable lacing fixture
24*a* first portion
24*b* second portion
25 latch
26 central aperture
28 main body wire channels
30 lacing fixture wire channels
32 breakaway portions
34 bridge portion
40 housing part
42 central aperture
44 first side
46 second side
48 third side
50 fourth side
52 fifth side
53 cavity
54 latch

55 latch
62 first end
64 second end
66 second grounding spring
68 first end
70 second end

What is claimed is:

1. A connector assembly comprising:
a. a connector part having a jack cavity;
b. a cable manager part conductively attached to the connector part, the cable manager part having:
i. a housing part having a first side and a second side, the housing part having a central aperture disposed between the first and second sides;
ii. a first grounding spring extending between the housing part first and second sides and at least partially across the central aperture, wherein when a cable is inserted through the aperture, the first grounding spring contacts a sheath of the cable to provide a grounding connection between the cable sheath and the housing and connector parts.

2. The connector assembly of claim 1, wherein
a. the first grounding spring is a helical spring.

3. The connector assembly of claim 1, further comprising:
a. a second grounding spring extending between the housing part first and second sides and at least partially across the central aperture.

4. The connector assembly of claim 1, wherein:
a. the first and second grounding springs are helical springs; and
b. the first grounding spring is disposed generally parallel to the second grounding spring.

5. The connector assembly of claim 1, wherein the cable manager part further includes:
a. a main body having a second aperture for receiving the cable and being coaxial with the housing part central aperture, wherein the main body is attached to the connector part and the housing part is connected to the main body.

6. The connector assembly of claim 5, further comprising:
a. a second grounding spring extending between the housing part first and second sides and at least partially across the second aperture.

7. The connector assembly of claim 6, wherein the first and second grounding springs are secured within the housing part by the main body.

8. The connector assembly of claim 7, wherein a portion of the housing part is formed from a conductive material and is in conductive connection with the connector part, and wherein the first and second grounding springs are in conductive contact with the conductive housing part portion.

9. The connector assembly of claim 5, wherein the main body includes a plurality of channels for receiving and retaining wires of the cable and a separable lacing fixture removably attached to the main body and having a plurality of channels for receiving each of the wires of the cable, wherein the separable lacing fixture is configured to be separated from the main body when the connector part is fully installed onto the main body.

10. A cable manager part configured to be installed onto a connector part of a connector, the cable manager part comprising:
a. a housing part having a first side and a second side, the housing part having a central aperture disposed between the first and second sides; and
b. a first grounding spring extending between the housing part first and second sides and at least partially across the central aperture, wherein when a cable is inserted through the central aperture, the first grounding spring contacts a sheath of the cable to provide a grounding connection between the cable sheath and the housing part.

11. The cable manager part of claim 10, further comprising:
a. a second grounding spring extending between the housing part first and second sides and at least partially across the central aperture.

12. The cable manager part of claim 11, wherein:
a. the first and second grounding springs are helical springs; and
b. the first grounding spring is disposed generally parallel to the second grounding spring.

13. The cable manager part of claim 12, wherein the cable manager part further includes:
a. a main body having a second aperture for receiving the cable and being coaxial with the housing part central aperture, wherein the main body is attached to the connector part and the housing part is connected to the main body.

14. The cable manager part of claim 13, wherein the first and second grounding springs are secured within the housing part by the main body.

15. The cable manager part of claim 14, wherein a portion of the housing part is formed from a conductive material configured for conductive connection with the connector part, and wherein the first and second grounding springs are in conductive contact with the conductive housing part portion.

16. The cable manager part of claim 14, wherein the main body includes a plurality of channels for receiving and retaining wires of a cable and a separable lacing fixture removably attached to the main body and having a plurality of channels for receiving each of the wires of the cable, wherein the separable lacing fixture is configured to be separated from the main body when the connector part is fully installed onto the main body.

17. A method of terminating a connector to a plurality of wires of a cable, the method including:
a. providing a cable manager part including:
i. a housing part having a central aperture; and
ii. at least one grounding spring extending across the central aperture;
b. inserting a cable having a plurality of wires and an exposed sheath through the central aperture such that the exposed sheath contacts the grounding spring;
c. partially inserting a connector part onto the cable manager part;
d. placing the connector part and the cable manager part within a wire connector tool;
e. actuating the wire connector tool to fully insert the connector part onto the cable manager part to form a connector such that the connector part, the cable manager part, and the sheath are each in conductive contact with the other; and
f. removing the connector from the wire connector tool.

18. The method of claim 17, wherein the step of providing a connector part includes providing an RJ-type connector.

19. The method of claim 17, wherein the step of providing a cable manager part includes providing two grounding springs extending at least partially across the central opening.

20. The method of claim 19, wherein the grounding springs are provided as helical springs.

* * * * *